US007431322B1

(12) United States Patent
Malak

(10) Patent No.: US 7,431,322 B1
(45) Date of Patent: Oct. 7, 2008

(54) SNOWBOARD THEFT DETERRENCE DEVICE

(76) Inventor: Sidney T. Malak, 4496 Red Spruce La., Manlius, NY (US) 13104

( * ) Notice: Subject to any disclaimer, the term of this patent is extended or adjusted under 35 U.S.C. 154(b) by 111 days.

(21) Appl. No.: 11/543,766

(22) Filed: Oct. 6, 2006

Related U.S. Application Data

(60) Provisional application No. 60/725,474, filed on Oct. 12, 2005.

(51) Int. Cl.
*A63C 11/00* (2006.01)

(52) U.S. Cl. ..... 280/617; 280/809; 280/814; 70/14; 70/58

(58) Field of Classification Search ..... 280/809, 280/814, 611, 613, 617, 618, 620; 70/14, 70/57, 58
See application file for complete search history.

(56) References Cited

U.S. PATENT DOCUMENTS 3,754,420 A * 8/1973 Oellerich ..... 705/58
4,419,872 A * 12/1983 Plifka ..... 70/18
5,782,476 A * 7/1998 Fardie ..... 280/14.24
5,802,887 A * 9/1998 Beland ..... 70/14
5,984,325 A * 11/1999 Acuna ..... 280/14.24
6,374,645 B1 * 4/2002 Fontes et al. ..... 70/18
6,422,048 B1 * 7/2002 Fontes et al. ..... 70/58
6,755,053 B1 * 6/2004 Dias ..... 70/14

* cited by examiner

*Primary Examiner*—Christopher Ellis
*Assistant Examiner*—John D Walters

(57) ABSTRACT

A theft deterrent security device for a snowboard, the security device is mounted on the base portion of the snowboard binding so as to cover the screws that pass through a rotator plate which attach the binding to the board. Not being able to easily remove the rotator plate on the board, the security device acts as a deterrent to someone wanting to steal the board. The security device consists of a security cover having a recess portion to receive a lock structure. This lock structure locks the security cover to the binding and prevents access to the screws on the rotator plate.

10 Claims, 6 Drawing Sheets

SNOWBOARD THEFT DETERRENCE DEVICE

This application claims benefit of application Ser. No. 60/725,474 filed Oct. 12, 2005.

FIELD OF INVENTION

This invention relates generally to the field of devices related to snowboards, and particularly to devices related to theft deterrence of snowboards.

BACKGROUND OF THE INVENTION

Snowboard bindings are attached to snowboards by screws and provide a structure to hold snowboard boots to the snowboard with a set of adjustable binding straps. The bindings also support heel supports to hold the heel of the snowboard boots firmly to the snowboard. There is a possibility that snowboards can be stolen at ski lodges when the rider comes in for a break from snowboarding and temporarily stands the snowboard outside of the lodge against a ski bar.

SUMMARY OF THE INVENTION

Briefly stated, it is an object of this invention to provide a security device on the snowboard binding as a deterrent to someone motivated to steal the snowboard. Most thieves will not want to hassle with a snowboard having a theft deterrence device. Therefore, a simple security device can be a deterrent to having the board stolen.

According to an embodiment of the invention, a security device is mounted on the base portion of the snowboard binding so as to cover the screws that pass through a rotator plate which attach the binding to the board. Not being able to easily remove or adjust the rotator plate on the board, the security device acts as a deterrent to someone wanting to steal the board. The security device consists of a security cover having a recess portion to receive a lock structure. This lock structure locks the security cover to the binding and prevents access to the screws on the rotator plate. The lock structure can take on different configurations and in one form is a straight flat metal bar having holes at its ends. A passage is made in each of the sidewalls of the binding to permit sliding the metal bar through into contact with the recess on the security cover. A standard lock, well known in the prior art, and in one form being similar to a key or combination locker lock or a wire lock, can be passed through one of the bar holes. Similarly, another lock can be passed through the other bar hole. In this way the lock structure securely locks the security cover to the binding.

BRIEF DESCRIPTION OF THE INVENTION

Figure 4:
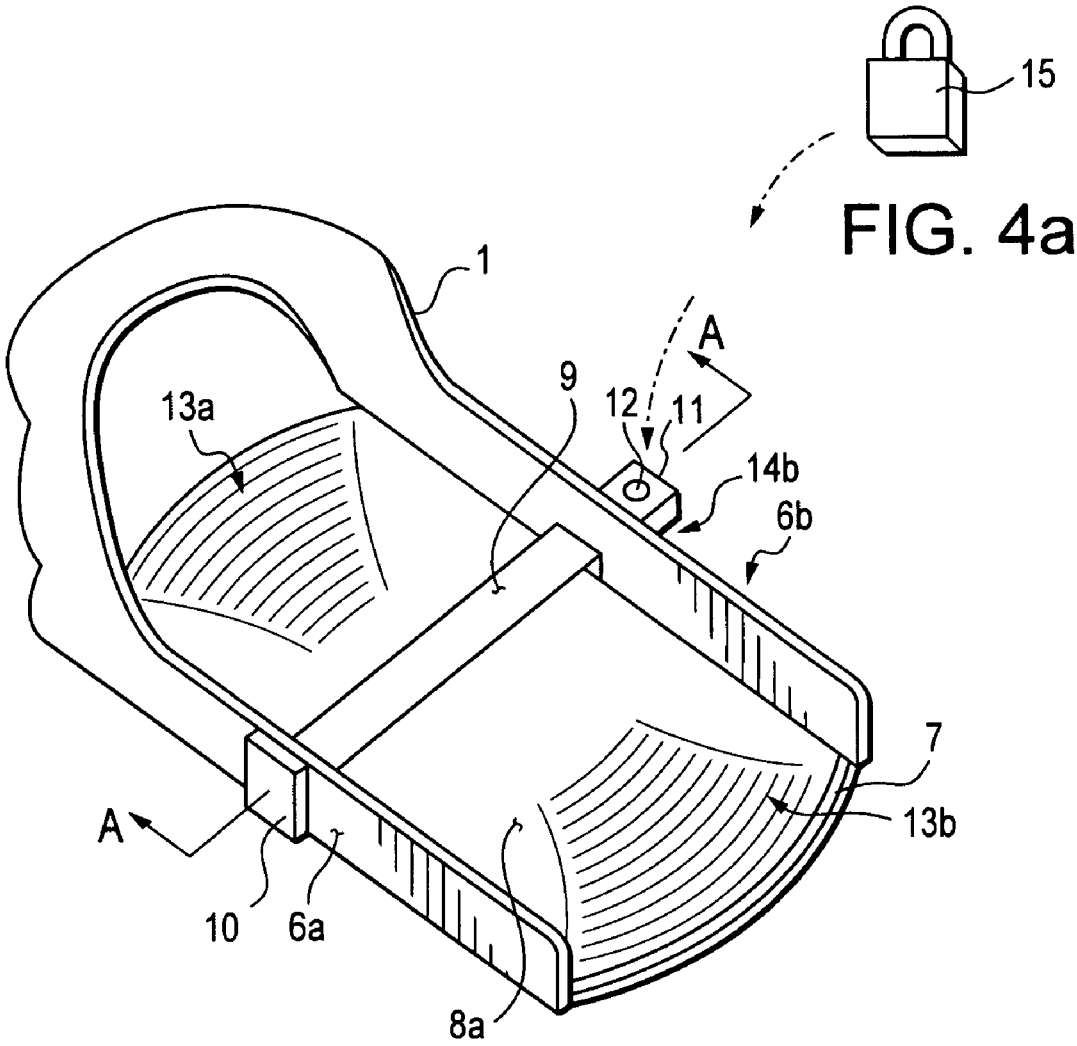
FIG. 4 is a perspective of FIG. 3. showing a detail of the first embodiment of the security cover.
Figure 5:
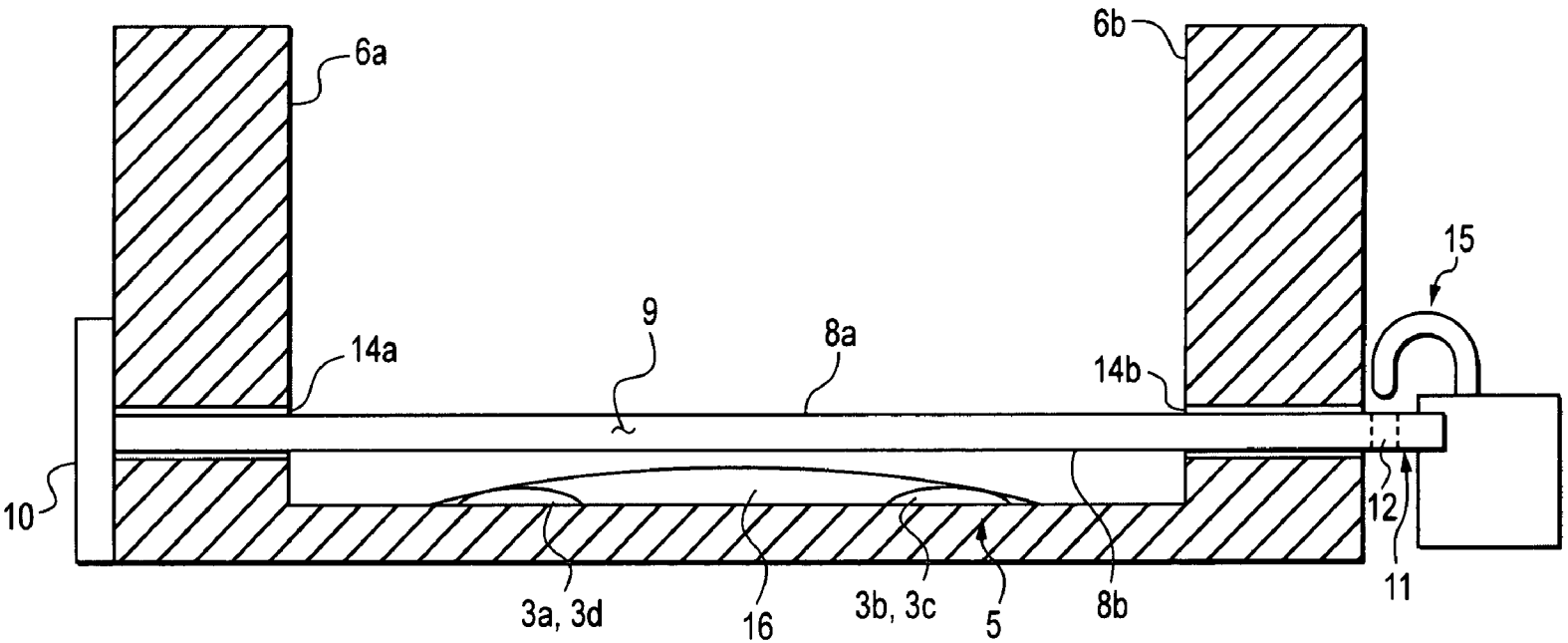
Figure 6:
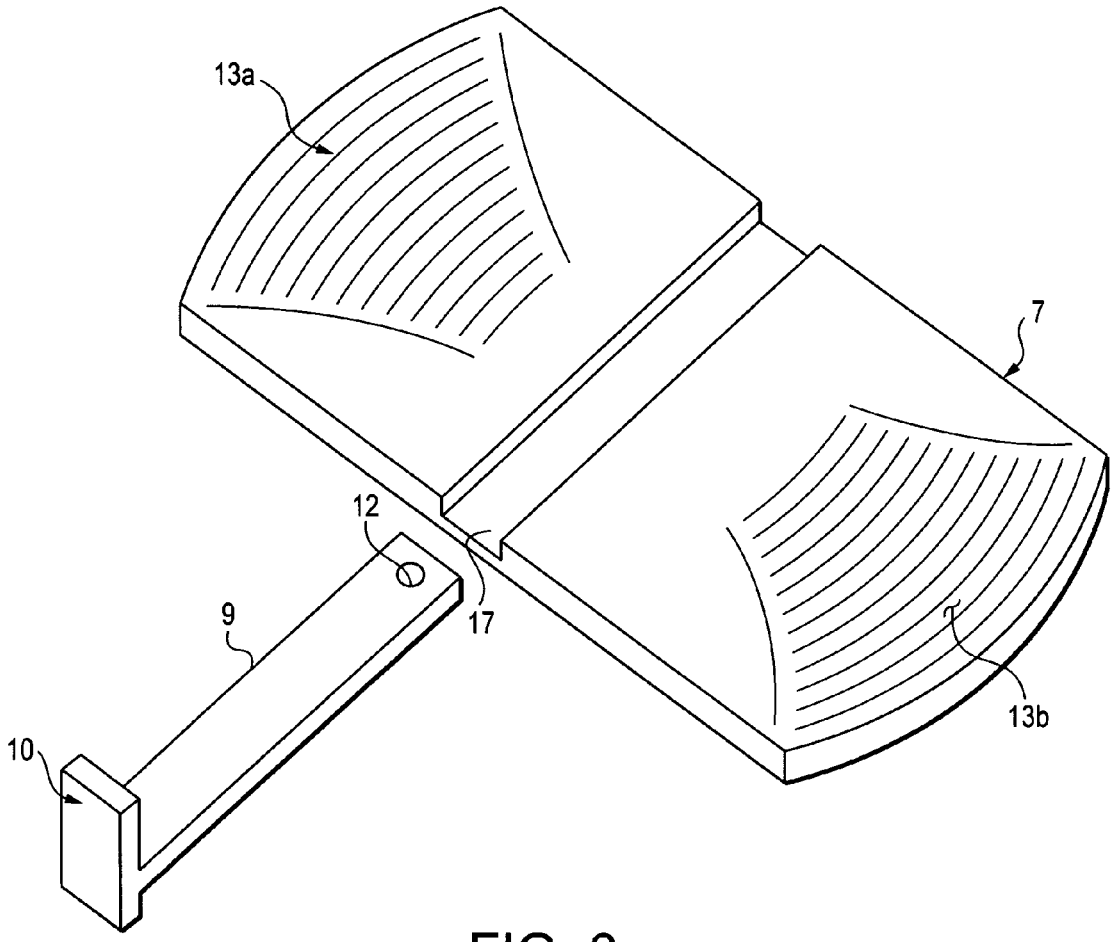
Figure 7:
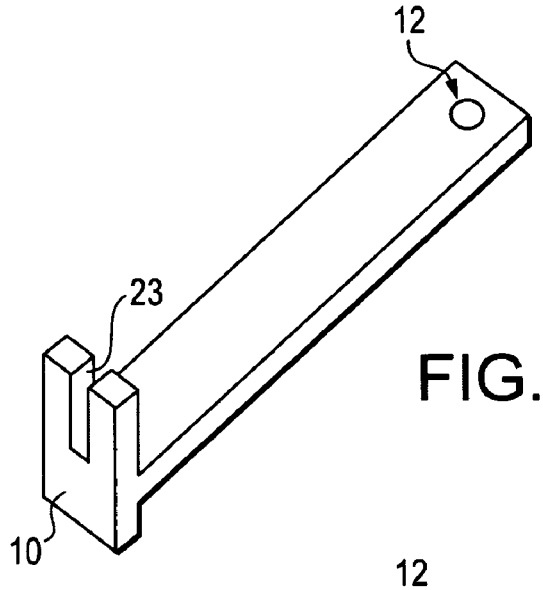
Figure 8:
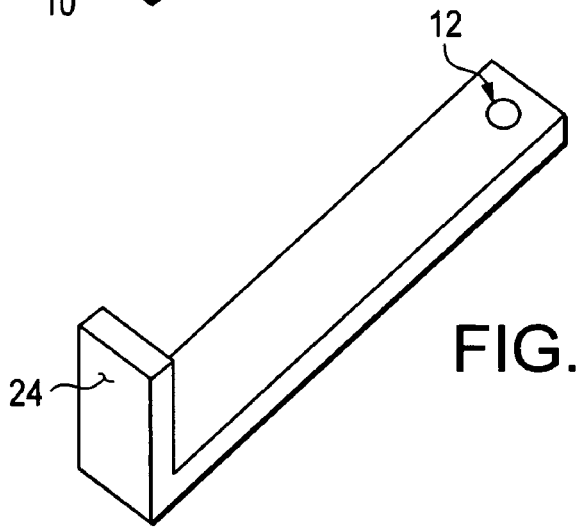
Figure 9:
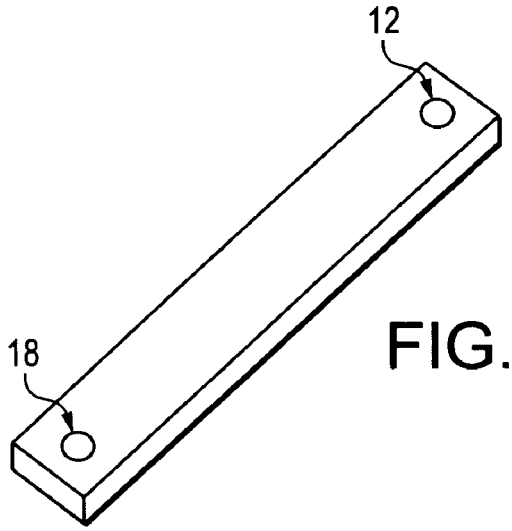

FIG. 5. is a cross-section taken along lines A-A of the binding shown in FIG. 4;

FIG. 6 is a perspective view of the security cover and lock structure;

FIG. 7 is a perspective of a T-shaped version of the lock structure;

FIG. 8 is a perspective of a L-shaped version of the lock structure;

FIG. 9 is a perspective of a straight bar version of the lock structure.

DETAILED DESCRIPTION OF THE PREFERRED EMBODIMENT

Description of Invention

Figure 1:
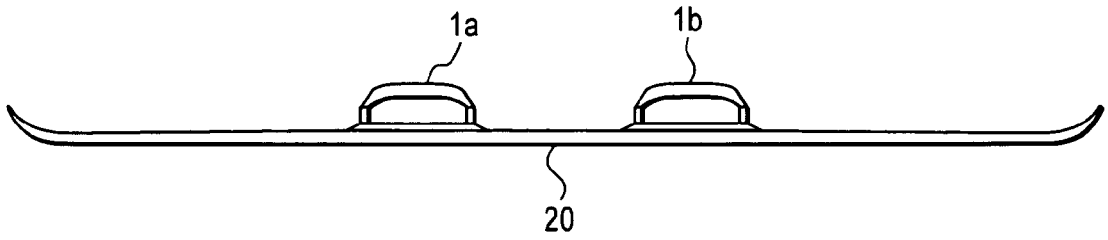
FIG. 1 shows a side view of a snowboard with bindings mounted thereon.
Figure 2:
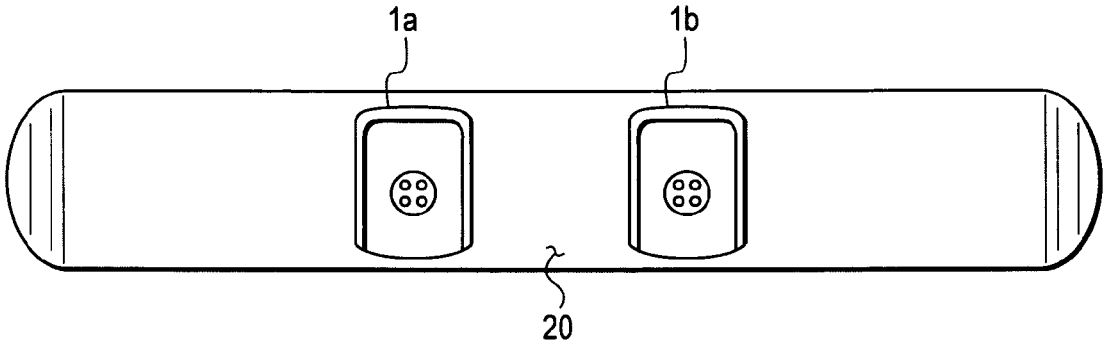
FIG. 2 is a top view of the snowboard of FIG. 1.
Figure 3:
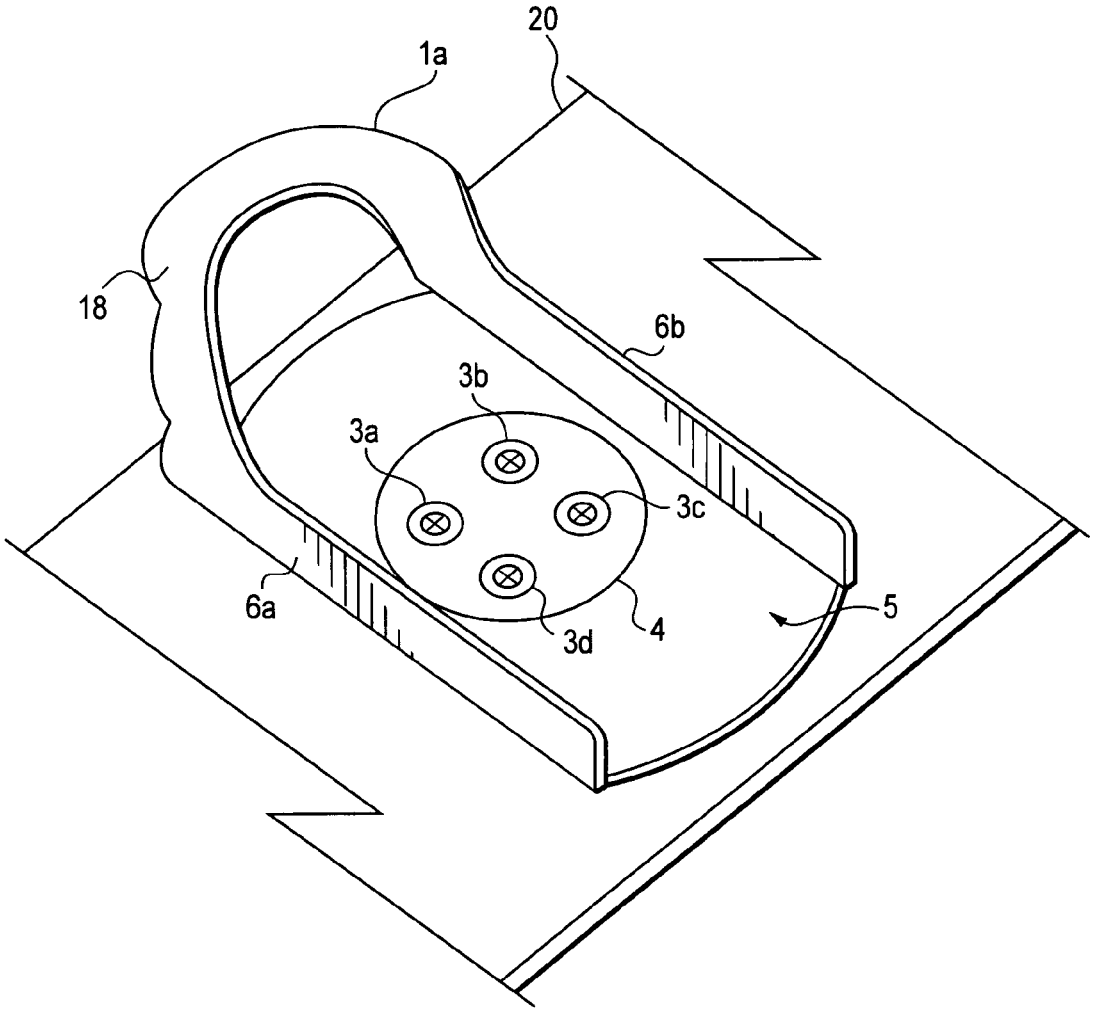
FIG. 3 is a detail perspective of one of the bindings shown in FIG. 2 on a portion of the snowboard.

The details of the invention are shown in FIGS. 1 through 9. FIGS. 1 and 2 show a typical configuration of a snowboard. The snowboard comprises a substantially flat base structure 20 with boot bindings 1*a* and 1*b* mounted thereon. Bindings 1*a* and 1*b* are attached to the snowboard 2 at a substantially perpendicular angle to the longitudinal axis of the snowboard. A detail of binding 1 is shown in FIG. 3. The binding is attached to the snowboard by screws 3*a*-3*d* that are located on rotator plate 4. The main purpose of the binding is to hold the rider's snowboard boots onto the snowboard. Not shown in FIGS. 3 and 4 are typical boot straps and heel holder back portion well known in the snow binding art. The binding comprises a base portion 5, a first side wall 6*a*, a second side wall 6*b*, and a heel holder strap portion 18. A metal rotator plate 4 is mounted on the bottom portion of the binding and fastened to the board with screws 3*a*-3*d*. These screws hold the binding and rotator plate to the snowboard. A theft deterrent device in the form of a theft deterrent structure or security cover 7 is shown in FIG. 4. The security cover is positioned over the rotator 4 such that the screws are covered and cannot be reached and removed. The security cover is held to the board by a lock structure that is slidingly passed through a first opening 14*a* in side wall 6*a* and through a second opening 14*b* in side wall 6*b* best shown in FIG. 5. The portion of the sliding lock structure that protrudes past side wall 6*b* has a hole through it which will permit a lock 15 to be passed through, thereby preventing the sliding lock device from being removed. The lock can be any typical key, wire or combination lock generally available in hardware stores and are well know in the art. In addition, the end portion 10 of the lock structure can have a hole or slot 23 as shown in FIG. 7 such that snowboard rider can string a wire lock through slot 23 through openings 14*a* and 14*b* of the binding side walls and fasten the wire lock to a ski rest rail generally located outside a ski lodge to thereby act as a theft deterrent. Accordingly, when the security cover is in place and correctly locked to the binding, the only way to steal the snowboard would be to cut the wire lock and lock.

FIG. 4 shows the details of the binding with the theft deterrence or security cover 7. The security cover consists of a top surface 8*a*, sliding lock structure 9, and boot grip portion 13. The sliding lock structure 9 slides on top of and rests or engages recess 17 of the security cover best shown in FIG. 6. This results in the lock structure securely holding the security cover in a fixed position within the binding, thereby locking he security cover into place and preventing the cover from moving around in the binding or being removed. The sliding lock structure 9 as shown in FIG. 5 is slipped through a first opening 14*a* in side wall 6*a* and through a second opening 14*b* in side wall 6*b*. End block portion 10 acts as a stop to prevent the sliding lock structure from slipping through the opening in side wall 6*a*. At the other end of the sliding lock structure is located an opening or hole 12 on portion 11 that is dimensioned to extend past side wall 6*b*. The hole 12 is dimensioned to accept a standard lock 15 to prevent the sliding lock structure from being removed form the binding.

Once the respective lock is inserted into hole 12, it prevents the sliding lock structure and the theft deterrence plate 7 from being removed from the binding. This makes it difficult to remove the screws. The only way the snowboard can be stolen is if the lock is cut. The theft deterrence plate 7 makes it difficult for someone to quickly unscrew the screws and unlatch the bindings to steal the snowboard and/or reposition the rotator plate for a different riding position.

FIG. 5, is a cross-section along line A-A of the binding of FIG. 4, showing a side view of the operation of the security cover 7 and sliding lock structure 9. As shown in FIG. 5, the sliding lock structure fits through opening 14*a* in side wall 6*a* and through opening 14*b* in side wall 6*b*. The sliding lock structure is preferably flush within the recess or groove 17 so as to define a generally smooth surface for the rider's boot on the top surface 8 of the security cover. This smooth configuration also prevents someone from prying the sliding lock structure up to thereby gain advantage in removing it. As is also seen, the bottom surface 8*b* of the theft deterrence plate 7 also has a concave recess portion 16 to provide clearance for screws 3*a*-3*d*.

FIG. 6, shows how the security cover 7 operates with the lock structure 9. The lock structure slides within groove 17 and is dimensioned to be flush with the top surface of the cover providing for a substantially flat surface for the snowboard boot to rest upon.

FIGS. 7, 8, and 9, show different variations that the sliding lock structure 9 can take. FIG. 7 shows a generally flat structure with a T-shaped lock end portion 10 having a slot 23 located therein. FIG. 8 shows a generally L-shaped structure having an end portion 24. FIG. 9 shows a generally straight flat structure with an extra hole 18 that is used in lieu of an end stop portion. The extra hole receives a lock 15 similar in function to the lock used for hole 12. It is also envisioned that the lock structure can take on cross-sections other than rectangular as depicted. Other typical cross sections can be square, semi-circular, oval or circular. In each instance the recess 17 will be correspondingly configured to receive the respective cross section chosen such that the result will be a generally smooth surface for the top surface of the security cover.

While the present invention had been described with reference to a particular preferred embodiment and the accompanying drawings, it will be understood by those skilled in the art that the invention is not limited to the preferred embodiment and that various modifications and the like could be made without departing from the scope and spirit of the invention as defined in the following claims.

What is claimed is:

1. A snowboard binding comprising:

a base portion having at least three holes, the base portion having a first side wall and a second side wall, the first side wall having a first opening and the second side wall having a second opening:

a rotator plate located on the base portion between the first side wall and the second side wall, the rotator plate having at least three rotator holes;

a lock structure operating with the first opening and the second opening; and a security cover having a first surface and a second surface, the second surface located on the base portion, such that the security cover covers the rotator holes, the security cover further having a recessed portion on the first surface, whereby the lock structure locks the security cover to the base portion upon the lock structure being passed through the first opening and the second opening in operation with the recessed portion.

2. A snowboard binding according to claim 1, wherein the first opening and the second opening are rectangular openings.

3. A snowboard binding according to claim 1, wherein the lock structure has a rectangular configuration having a first end and a second end.

4. A snowboard binding according to claim 3, wherein the lock structure has a stop portion at the first end and a hole passing through the lock structure at the second end.

5. A snowboard binding according to claim 3, wherein the lock structure has a hole at the first end and a hole at the second end.

6. A snowboard binding according to claim 4, wherein the stop portion has a T-shaped configuration.

7. A snowboard binding according to claim 4, wherein the stop portion has a L-shaped configuration.

8. A snowboard binding according to claim 1, wherein the recessed portion is a rectangular groove.

9. A snowboard binding according to claim 1, wherein the recessed portion is semi-circular in configuration.

10. A snowboard binding according to claim 1, wherein the base portion has thereon a grooved grip portion.

* * * * *